US007845497B1

(12) United States Patent
Zhadanov et al.

(10) Patent No.: US 7,845,497 B1
(45) Date of Patent: Dec. 7, 2010

(54) SHOWER BOX

(76) Inventors: Sam Zhadanov, 2944 W. 5th St., Apt. 20J, Brooklyn, NY (US) 11224; Eli Zhadanov, 2944 W. 5th St., Apt. 20J, Brooklyn, NY (US) 11224

( * ) Notice: Subject to any disclaimer, the term of this patent is extended or adjusted under 35 U.S.C. 154(b) by 0 days.

(21) Appl. No.: 12/800,402

(22) Filed: May 15, 2010

(51) Int. Cl.
*B65D 79/00* (2006.01)

(52) U.S. Cl. ..... 206/745; 206/576; 206/775; 206/784

(58) Field of Classification Search ..... 206/745, 206/746, 747, 748, 749, 750, 756, 763, 769, 206/770, 576, 320, 775, 778, 779, 784
See application file for complete search history.

(56) References Cited

U.S. PATENT DOCUMENTS

| | | | | |
|---|---|---|---|---|
| 5,325,960 | A * | 7/1994 | Sims | 206/765 |
| 6,234,308 | B1 * | 5/2001 | Saffron et al. | 206/316.2 |
| 2003/0159963 | A1 * | 8/2003 | Merk | 206/470 |

* cited by examiner

*Primary Examiner*—Jacob K Ackun, Jr.
(74) *Attorney, Agent, or Firm*—I. Zborovsky

(57) ABSTRACT

A shower box for accommodating a shower handle with a shower head and also a hose connectable therewith, the shower box comprising three trays each in an unfolded condition follow one another in a longitudinal direction of one piece with one another and include a central tray having a substantially uninterrupted bottom and side walls extending in a longitudinal direction, a first end tray having a bottom provided with a longitudinal slot for at least partially centering the shower handle and a shower head and having side walls and means for fixing said hose provided with a viewing window, and a second end tray having a cutout for exposing said shower handle with said shower head and also a part of said hose, said trays being foldable over one another so that said central tray forms a bottom tray, said first end tray forms an intermediate tray, and said second end tray forms a top tray in a folded condition, in a direction perpendicular to the longitudinal direction; and a transparent cover located between said central tray and said second end tray in the folded condition so as to cover the shower handle with the shower head and also the hose.

7 Claims, 6 Drawing Sheets

VERTICAL SIDE CROSS SECTION

SHOWER BOX

BACKGROUND OF THE INVENTION

The present invention relates to shower boxes for accommodating shower components, in particular a shower handle with a showerhead and respective hoses.

Shower boxes of the above mentioned general type are known in the art. It is believed that the existing shower boxes can be further improved.

SUMMARY OF THE INVENTION

Accordingly, it is an object of the present invention to provide a shower box which is a further improvement of the existing shower boxes.

In keeping with these objects and with others which will become apparent hereinafter, one feature of the present invention resides, briefly stated, in a shower box for accommodating a shower handle with a shower head and also a hose connectable therewith, the shower box comprising three trays each in an unfolded condition follow one another in a longitudinal direction of one piece with one another and include a central tray having a substantially uninterrupted bottom and side walls extending in a longitudinal direction, a first end tray having a bottom provided with a longitudinal slot for at least partially centering the shower handle and a shower head and having side walls and means for fixing said hose provided with a viewing window, and a second end tray having a cutout for exposing said shower handle with said shower head and also a part of said hose, said trays being foldable over one another so that said central tray forms a bottom tray, said first end tray forms an intermediate tray, and said second end tray forms a top tray in a folded condition, in a direction perpendicular to the longitudinal direction; and a transparent cover located between said central tray and said second end tray in the folded condition so as to cover the shower handle with the shower head and also the hose.

Another feature of the present invention resides, briefly stated, in that side walls of each of said trays have a height reducing in the longitudinal direction, so that in the folded condition the shower box has a thickness reducing in a longitudinal direction.

A further feature of the present invention resides in that a thickness of said tray is selected so that in the folded condition a greatest height of the shower box is substantially equal to a smallest guide height of the shower box plus a height of a protruding portion of the showerhead so that in the folded condition the shower box together with the shower head has a substantially identical thickness.

A further feature of the present invention resides in that the shower box in the folded condition has a lower standing surface, and also an upper flap provided with an opening for suspending the shower box.

A further feature of the present invention resides in that said transparent element has a central protruding part so as to form a central depression in which the shower handle and the shower head are partially engageable.

A further feature of the present invention resides in that said transparent element is substantially rectangular and has four corners with four corner protrusions such that in the folded condition the second end tray lie said protrusions.

A further feature of the present invention resides in that said trays together form a one-piece element which in the unfolded position is provided with images selected from the group consisting of pictures, text, and both only one side of said one piece element.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

A shower box in accordance with the present invention is provided for accommodating a shower handle with a shower head and also hoses for the same.

Figure 1:
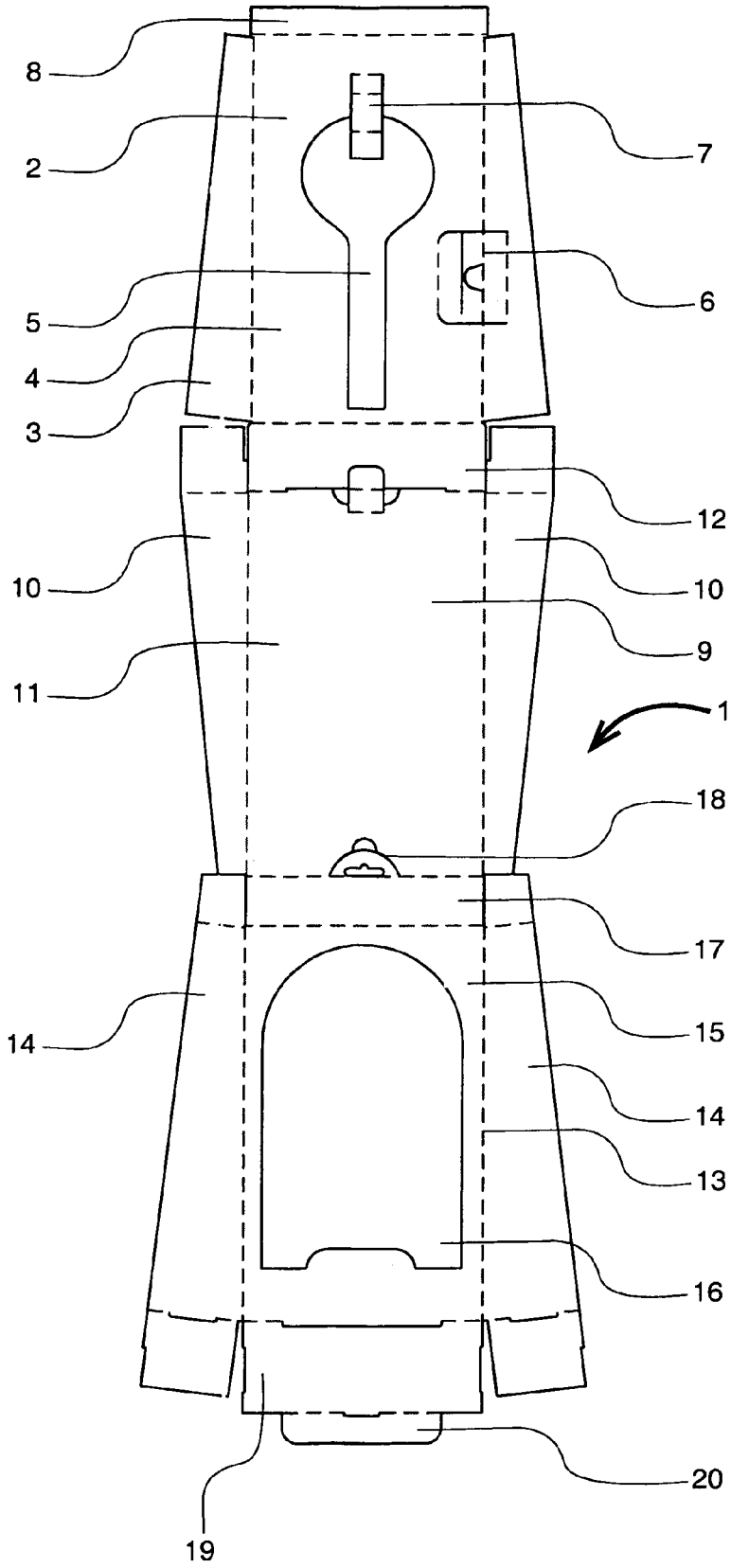
FIG. 1 is a view showing a shower box including three trays in an unfolded condition and formed as a one-piece element.
Figure 2:
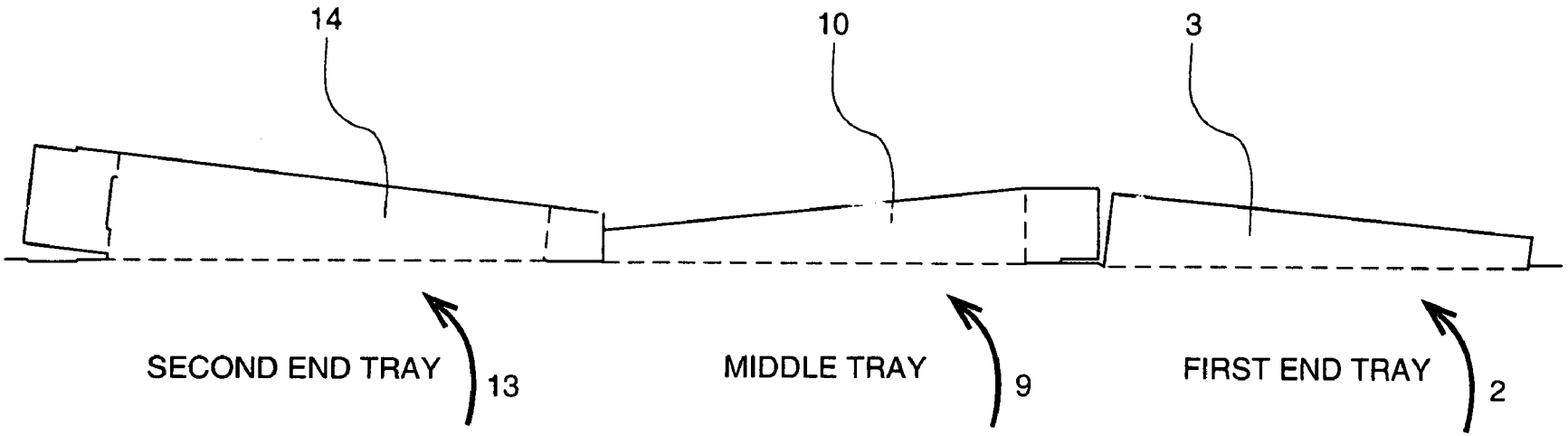
FIG. 2 is a side view of the one-piece element including the trays, with lifted side walls.
Figure 3:
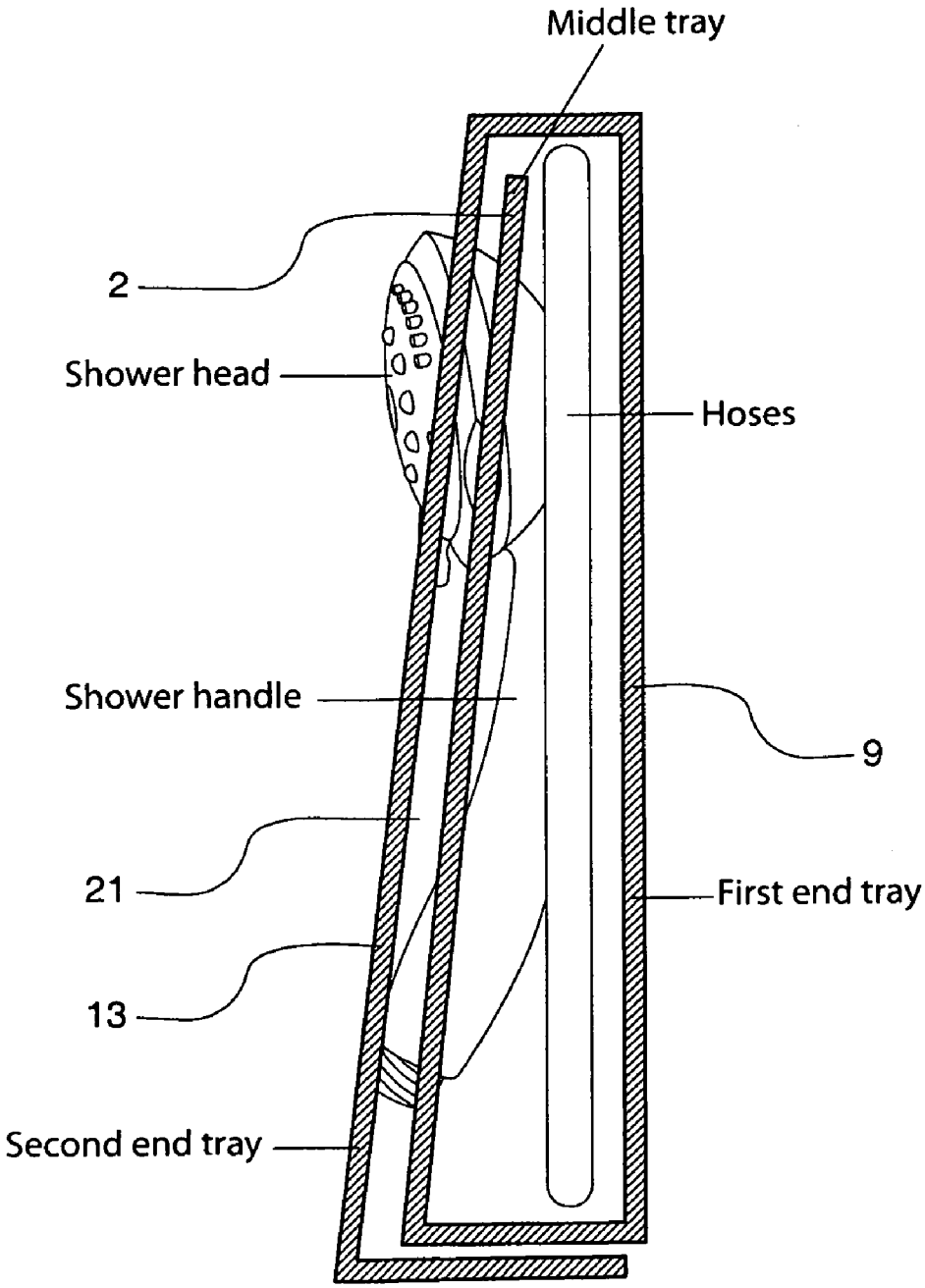
FIG. 3 is a view showing a vertical cross-section of the shower box in a folded condition with a shower handle and a showerhead as well as with hoses in it.
Figure 4:
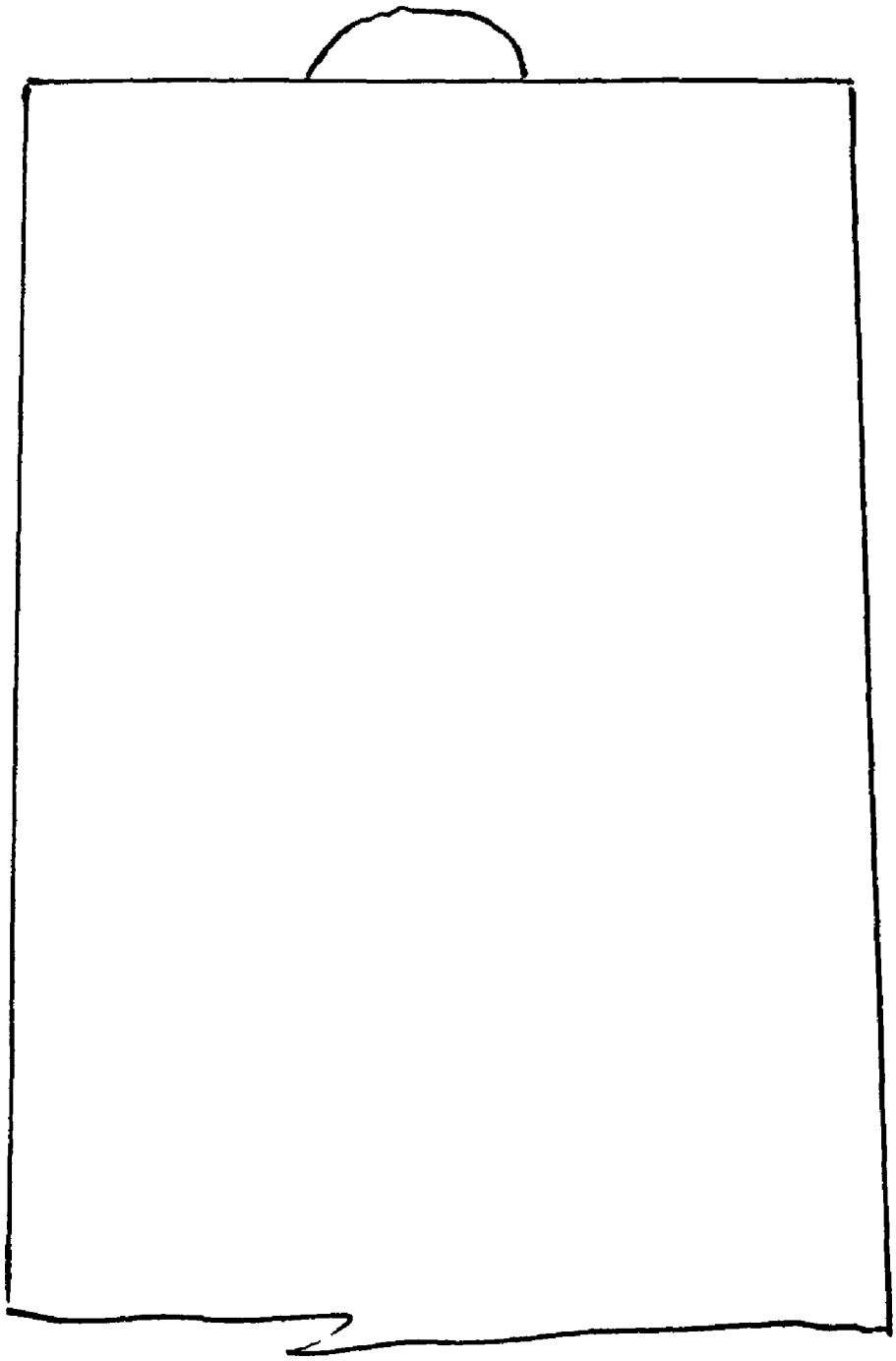
FIG. 4 is a back view of a first end side tray.

The shower head has three trays, including a middle tray, a first end tray and a second end tray which are connected with one another so as to form a one-piece element 1 shown in FIG. 1.

The first end tray is identified with reference numeral 2. It has two side walls 3 extending in a longitudinal direction of the one-piece element 1 and having a reducing height when they are folded perpendicular to a bottom 4 of this tray. The bottom 4 is provided with a cutout 5 for holding and at the same time exposing a shower handle with a shower head. The tray 2 has a foldable pocket 6 through which hoses can slide, and a wrapping member 7 which wraps around the hoses to hold the hoses in place. The pocket 6 and the flap 7 are made of a material of the tray 2 of one-piece with it. Finally, the tray 2 is provided with an end flap 8.

The middle tray is identified with reference numeral 9. It has side walls 10 extending in the longitudinal direction and having a reducing height when lifted perpendicular to a bottom 11. The middle tray 9 is connected with the first end tray 2 by a partition 12.

The second end tray is identified with reference numeral 13. It has side walls 14 extending in the longitudinal direction and having a reducing height when lifted to extend perpendicular to a bottom 15. The tray 13 has a wide and long cutout 16 through which the shower handle with a shower head as well as a part of the hoses is exposed in the folded condition. The tray 13 is connected to the tray 9 by a partition 17. A pull up tag is provided for hanging the shower box in the folded, assembled condition. The opposite side of the partition 17 a flap 19 is provided with a smaller flap 20.

A transparent element 21 formed for example of a transparent plastic is further provided to be located between the middle tray and second tray in the folded, assembled position of the shower box. It has a central protrusion 22 in which the shower handle and the shower head is partially engaged, and also corner protrusions 23 located at four corners of the rectangular transparent element, on which in the folded assembled condition the bottom of the second end tray directly lies.

Figure 5:
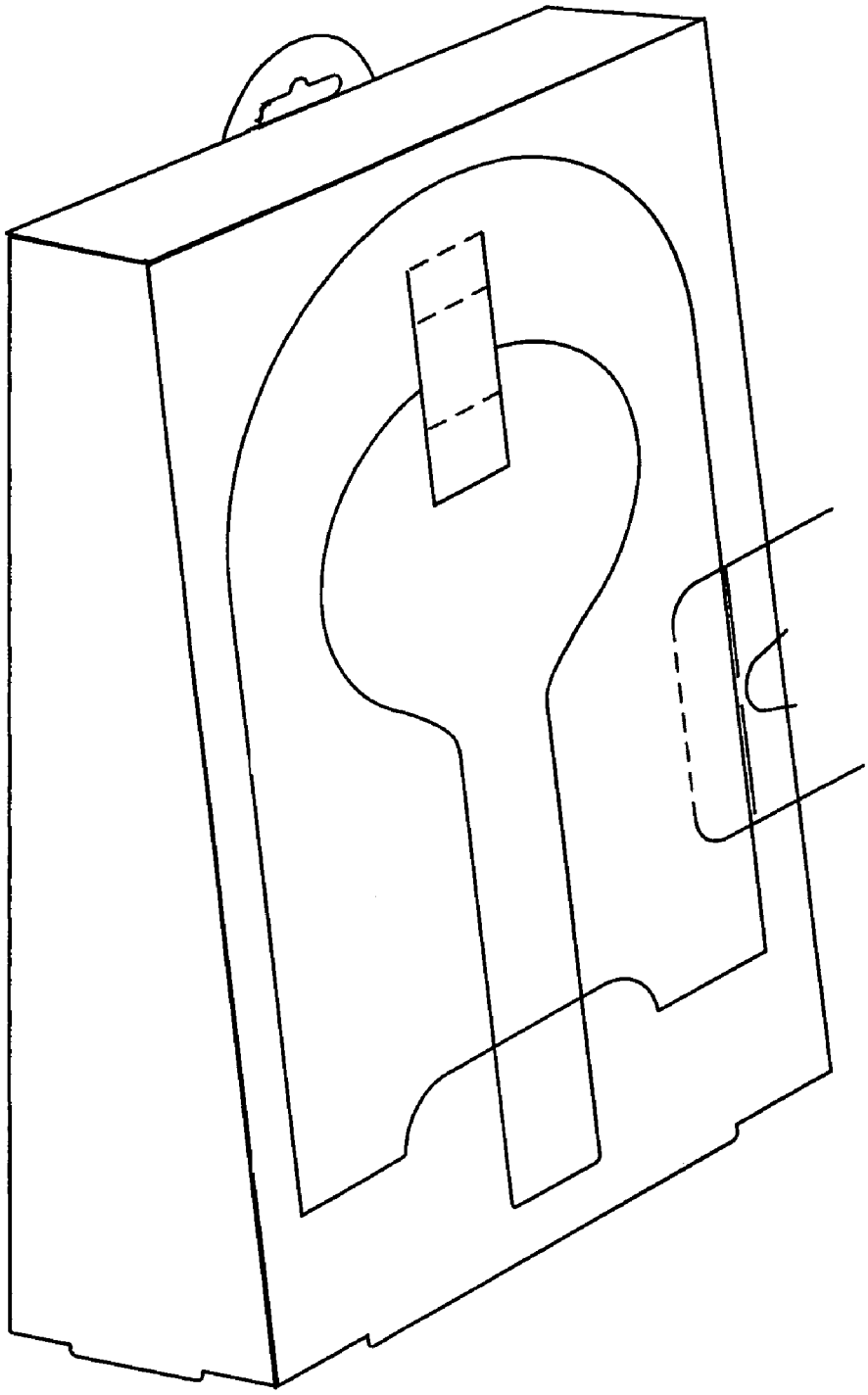
FIG. 5 is a view showing the shower box in a folded condition extending vertical.
Figure 6:
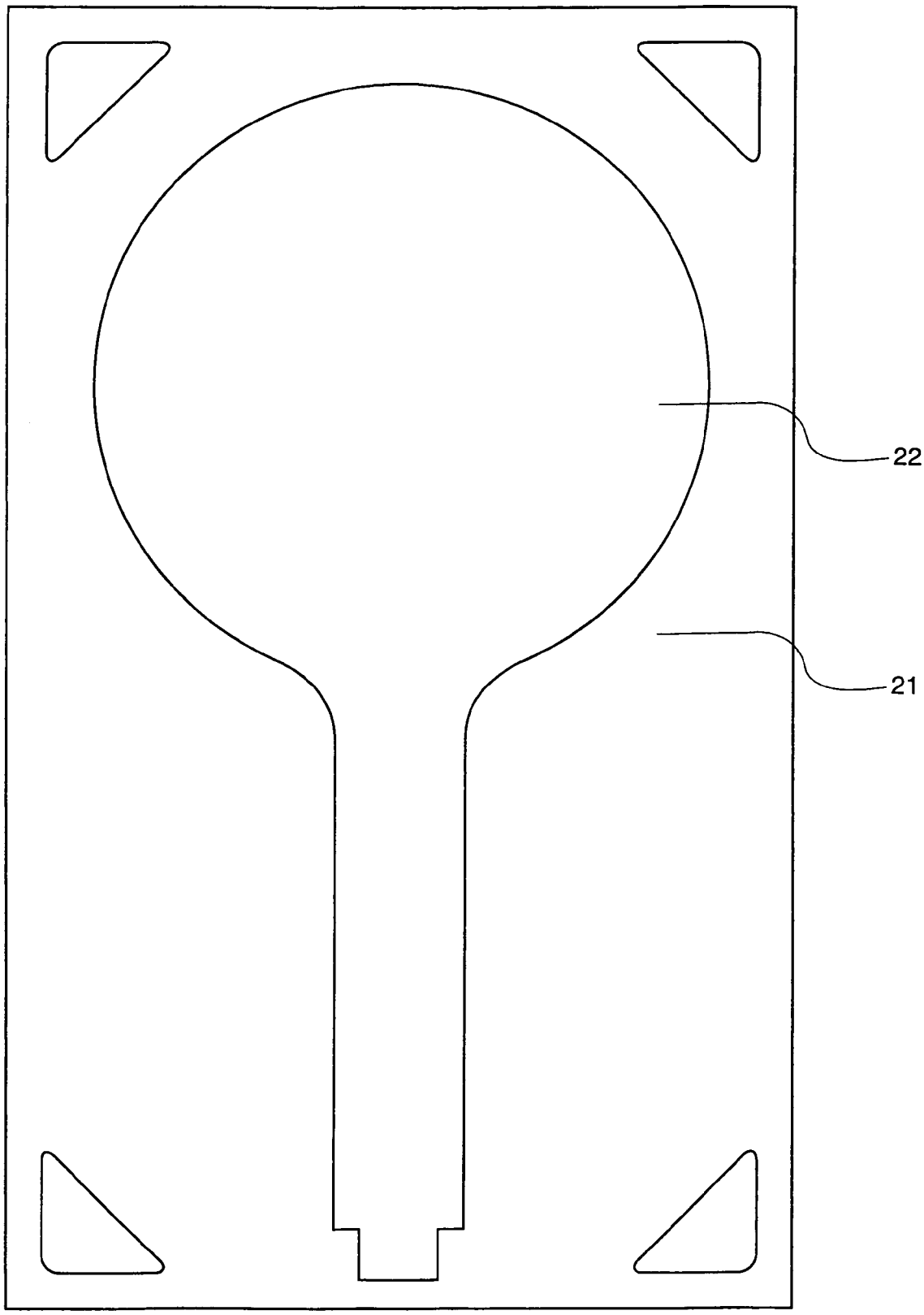
FIG. 6 is a view showing a transparent element, for example of plastic to be located between the first end flap and the second end flap and covering the shower handle, shower head, and hoses.

As can be seen from FIG. 5 in the folded assembled condition when the shower box stands vertically, its front surface facing a consumer is inclined. This makes it easy to observe the shower handle with the shower head and the hoses.

Because of this inclination the shower box stands stable and keeps a good balance. It also, because of the disinclination and the side walls which have a reducing height, economy of a material is achieved as well.

The dimensions of the shower box are selected so that when the shower handle and the shower head and the hoses are accommodated in the shower box, the thickness of the left higher surface is substantially equal to the thickness of the right lower surface plus the thickness of the portion of the shower handle with the shower head, so that the upper surface of the assembly is also substantially horizontal. Thereby the shower boxes with the shower head, the shower handle and the hoses in assembled condition can safely stand over one another in a stack.

It will be understood that each of the elements described above, or two or more together, may also find a useful application in other types of constructions differing from the type described above.

While the invention has been illustrated and described as embodied in a showerhead system, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A shower box for accommodating a shower handle with a shower head and also a hose connectable therewith, the shower box comprising three trays each in an unfolded condition follow one another in a longitudinal direction of one piece with one another and include a central tray having a substantially uninterrupted bottom and side walls extending in a longitudinal direction, a first end tray having a bottom provided with a longitudinal slot for at least partially centering the shower handle and a shower head and having side walls and means for fixing said hose provided with a viewing window, and a second end tray having a cutout for exposing said shower handle with said shower head and also a part of said hose, said trays being foldable over one another so that said central tray forms a bottom tray, said first end tray forms an intermediate tray, and said second end tray forms a top tray in a folded condition, in a direction perpendicular to the longitudinal direction; and a transparent cover located between said central tray and said second end tray in the folded condition so as to cover the shower handle with the shower head and also the hose.

2. A shower box as defined in claim 1, wherein said side walls of each of said trays have a height reducing in the longitudinal direction, so that in the folded condition the shower box has a thickness reducing in a longitudinal direction.

3. A shower box as defined in claim 2, wherein a thickness of said tray is selected so that in the folded condition a greatest height of the shower box is substantially equal to a smallest guide height of the shower box plus a height of a protruding portion of the showerhead so that in the folded condition the shower box together with the shower head has a substantially identical thickness.

4. A shower box as defined in claim 2, wherein the shower box in the folded condition has a lower standing surface, and also an upper flap provided with an opening for suspending the shower box.

5. A shower box as defined in claim 1, wherein said transparent element has a central protruding part so as to form a central depression in which the shower handle and the shower head are partially engageable.

6. A shower box as defined in claim 5, wherein said transparent element is substantially rectangular and has four corners with four corner protrusions such that in the folded condition the second end tray lie on said protrusions.

7. A shower box as defined in claim 1, wherein said trays together form a one-piece element which in the unfolded position is provided with images selected from the group consisting of pictures, text, and both only on one side of said one piece element.

* * * * *